US011849828B2

(12) United States Patent
Lecureuil et al.

(10) Patent No.: US 11,849,828 B2
(45) Date of Patent: Dec. 26, 2023

(54) DEVICE FOR A COSMETIC PRODUCT, IN PARTICULAR A LIPSTICK

(71) Applicant: ALBEA SERVICES, Gennevilliers (FR)

(72) Inventors: Frédéric Lecureuil, Gennevilliers (FR); Mark Edmondson, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 17/549,082

(22) Filed: Dec. 13, 2021

(65) Prior Publication Data

US 2022/0400834 A1 Dec. 22, 2022

(30) Foreign Application Priority Data

Jun. 16, 2021 (FR) ..... 2106377

(51) Int. Cl.
*A45D 40/06* (2006.01)
*A45D 40/00* (2006.01)
*A45D 40/12* (2006.01)

(52) U.S. Cl.
CPC ..... *A45D 40/06* (2013.01); *A45D 40/12* (2013.01); *A45D 2040/0018* (2013.01); *A45D 2040/0025* (2013.01)

(58) Field of Classification Search
CPC ..... A45D 40/06; A45D 2040/0018; A45D 2040/0025; A45D 40/12; A45D 40/04; A45D 40/02; A45D 40/065; A45D 2040/208
USPC ..... 401/75–78, 88
See application file for complete search history.

(56) References Cited

U.S. PATENT DOCUMENTS 5,096,318 A * 3/1992 Susini ..... A45D 40/06 401/78
5,143,464 A * 9/1992 Susini ..... A45D 40/06 401/74
6,036,387 A * 3/2000 Gueret ..... A45D 40/06 401/78
6,139,208 A * 10/2000 Monin-Bareil ..... A45D 40/06 401/78

(Continued)

FOREIGN PATENT DOCUMENTS

GB 671388 5/1952
WO 2020193497 A1 10/2020

*Primary Examiner* — David J Walczak
(74) *Attorney, Agent, or Firm* — Kilpatrick Townsend & Stockton LLP

(57) ABSTRACT

A device intended to be mounted on a base for actuating a cosmetic product application receptacle, in particular a cosmetic product stick is designed to get the cosmetic product out by at least one rotational movement. The device includes at least one guide, a cup intended to receive the cosmetic product and a sheath, the sheath including internally at least one helical groove and the guide being rotatably mounted in the sheath, the rotation of the guide relative to the sheath causing an axial movement of the cup between a fully extended position and a fully retracted position. The device includes at least one structure rotationally locking the guide relative to the sheath when the cup is in the fully extended position and/or the fully retracted position and/or close to being in the fully extended position and/or the fully retracted position.

7 Claims, 9 Drawing Sheets

(56) References Cited

U.S. PATENT DOCUMENTS

| | | | | |
|---|---|---|---|---|
| 6,244,770 | B1 * | 6/2001 | Holloway | A45D 40/06<br>401/78 |
| 9,820,550 | B2 * | 11/2017 | Heraud | A45D 40/02 |
| 2021/0076803 | A1 | 3/2021 | Trochel | |
| 2021/0321745 | A1 * | 10/2021 | Jourdain | A45D 40/06 |
| 2022/0183444 | A1 | 6/2022 | Mueller | |

* cited by examiner

[Fig.1]
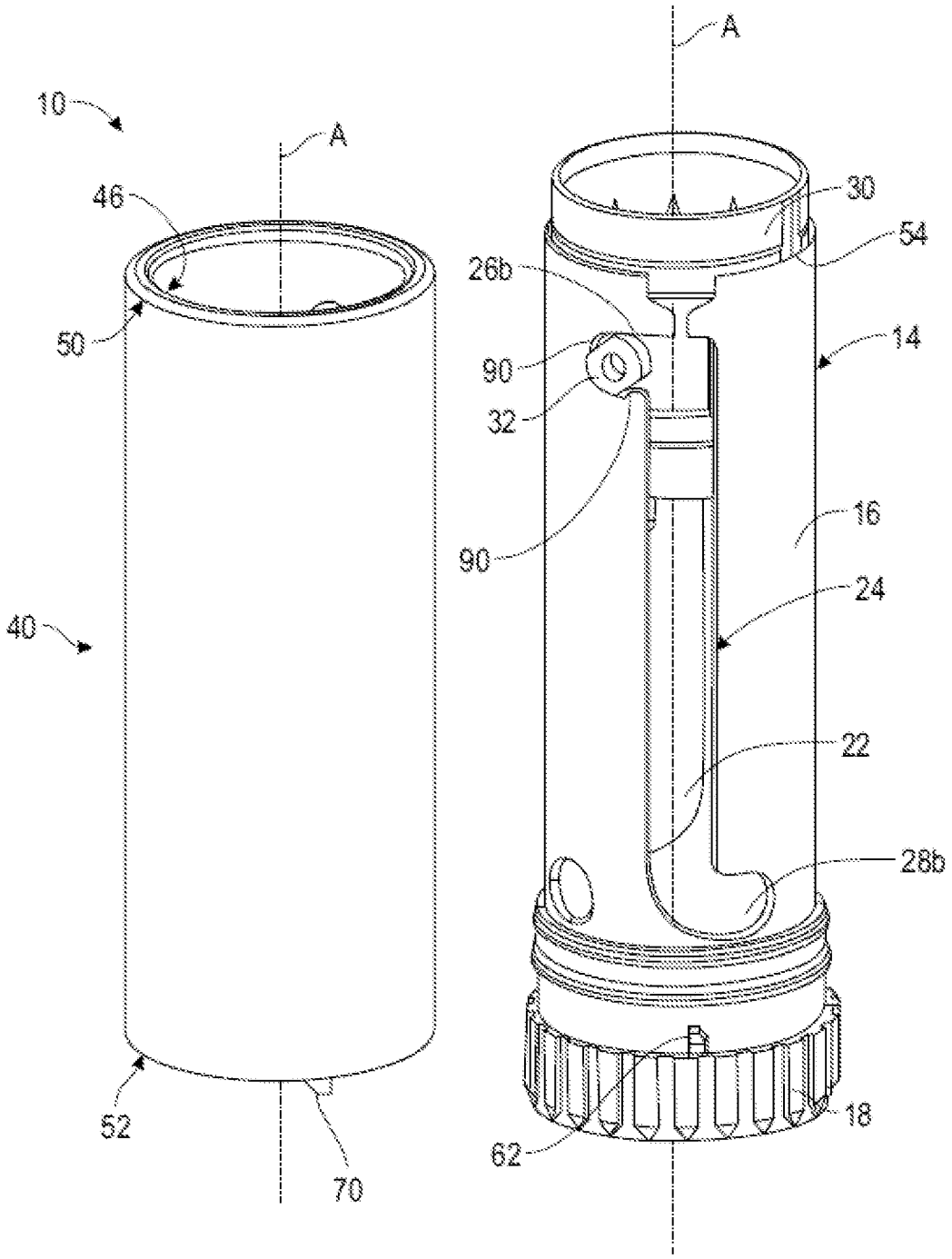

[Fig.2]
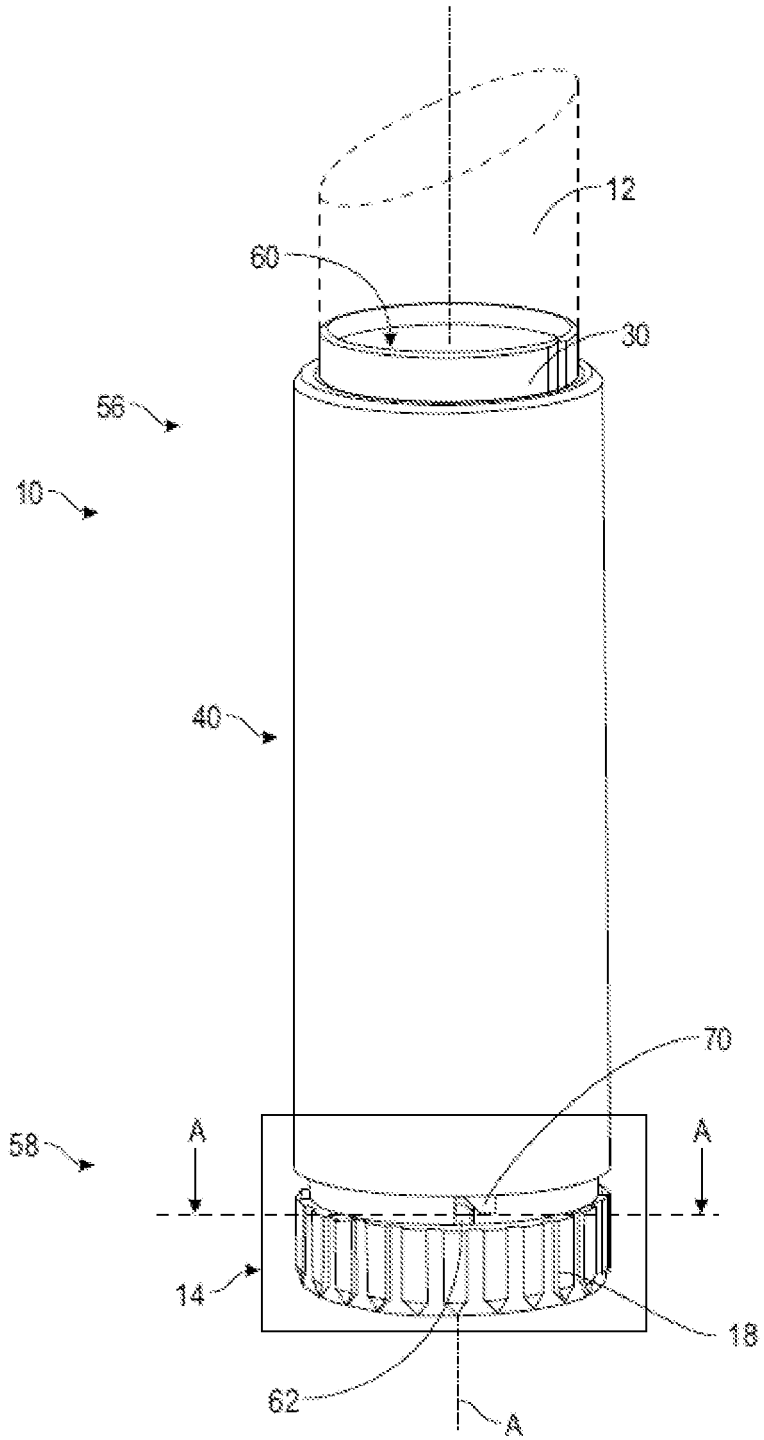

[Fig.3]
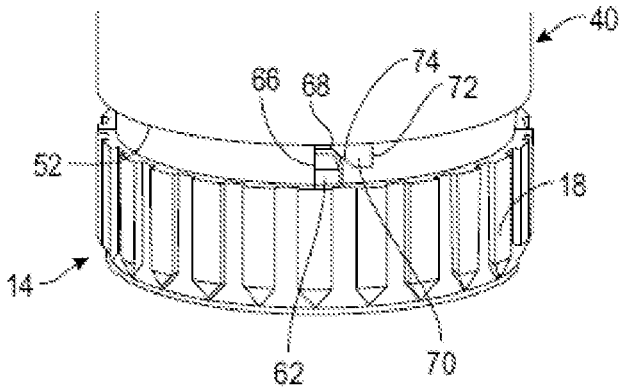
[Fig.4]
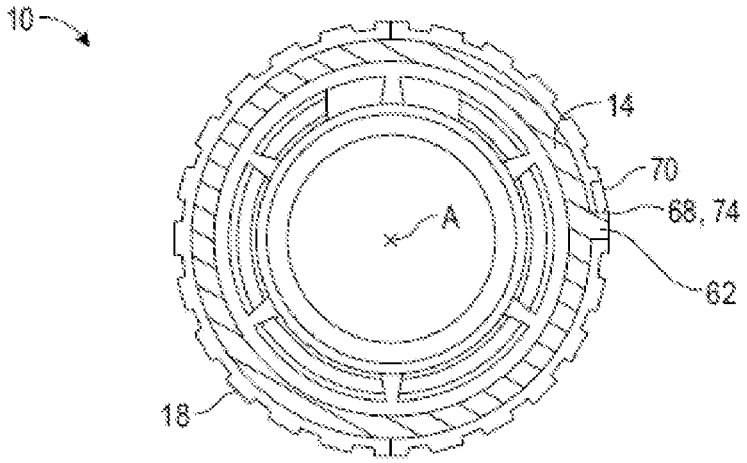

[Fig.5]
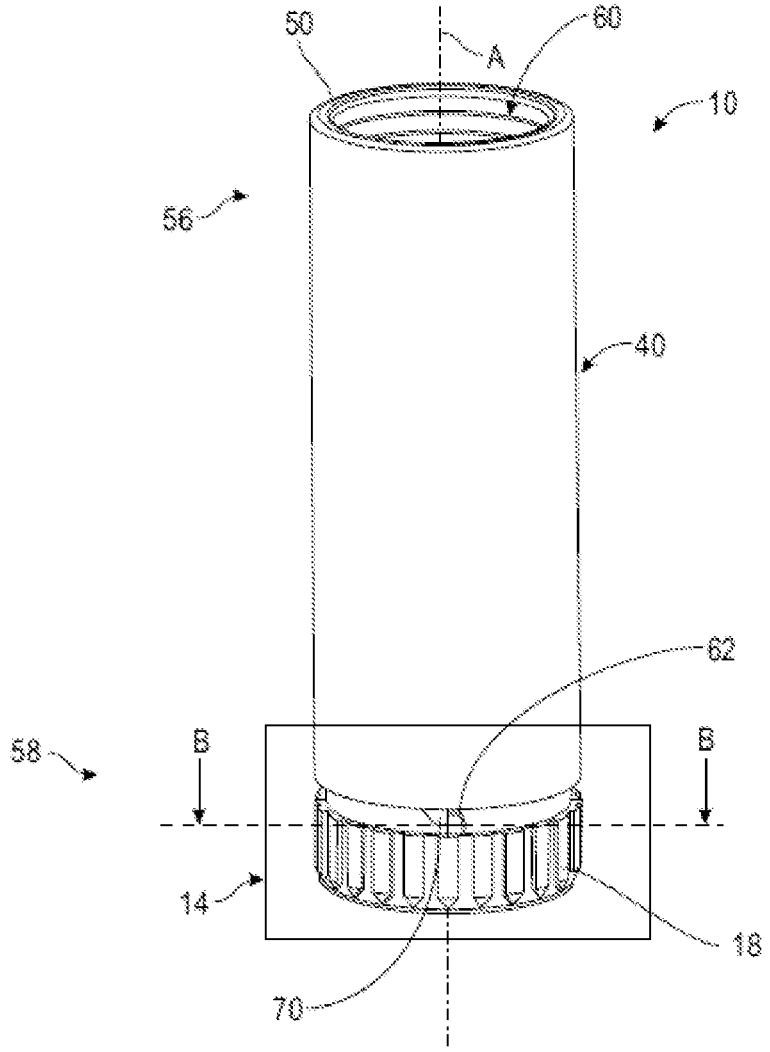
[Fig.6]
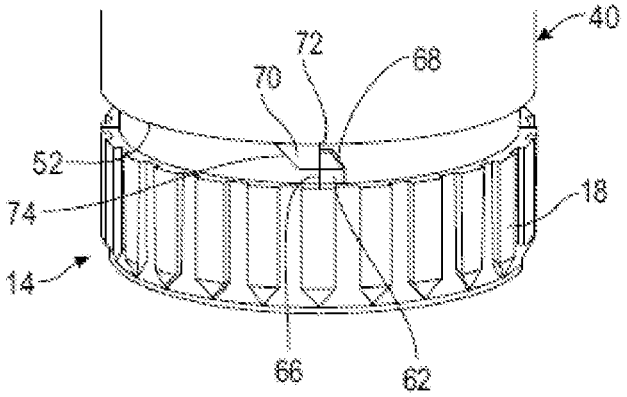

[Fig.9]
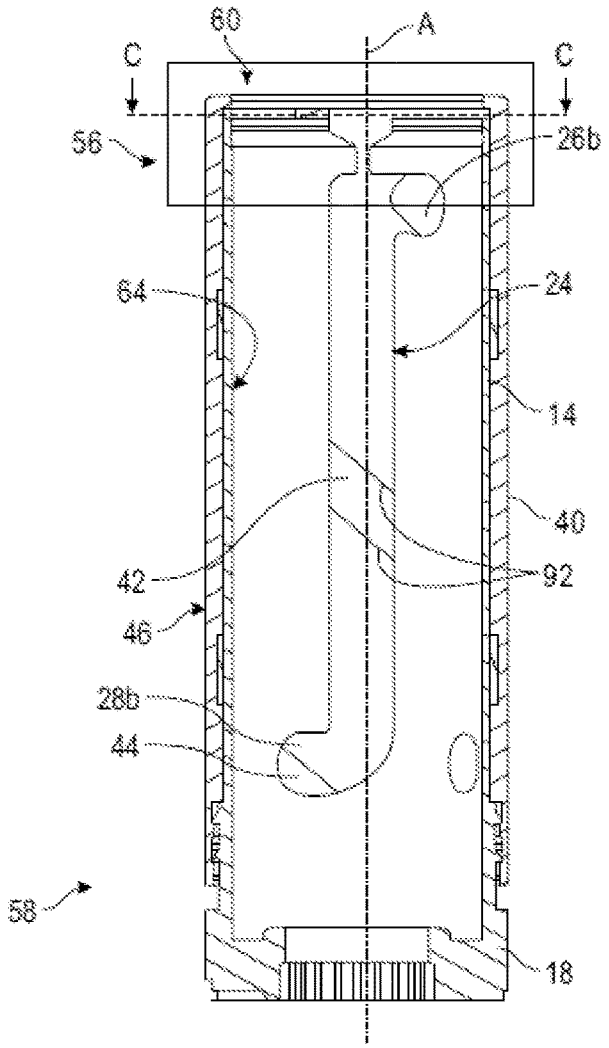
[Fig.10]
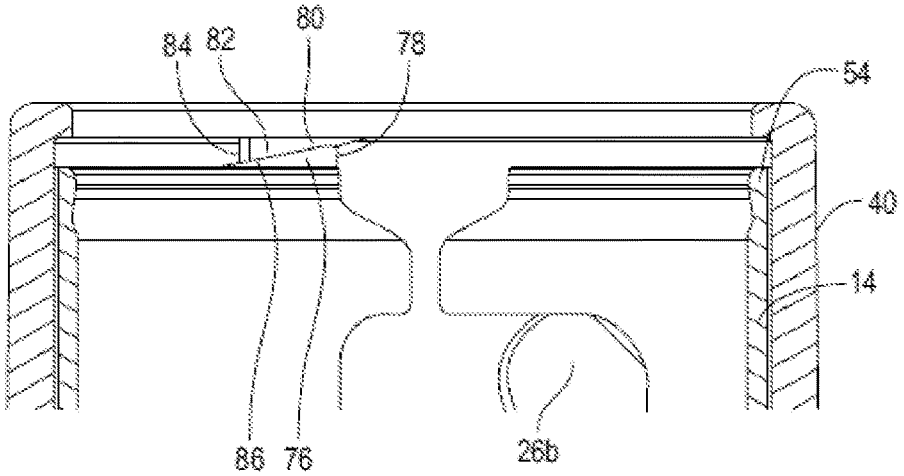

[Fig.11]
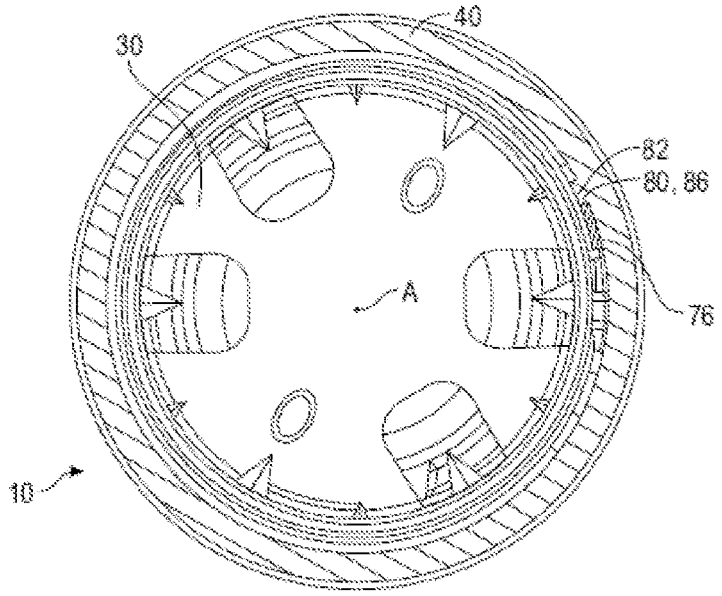
[Fig.12]
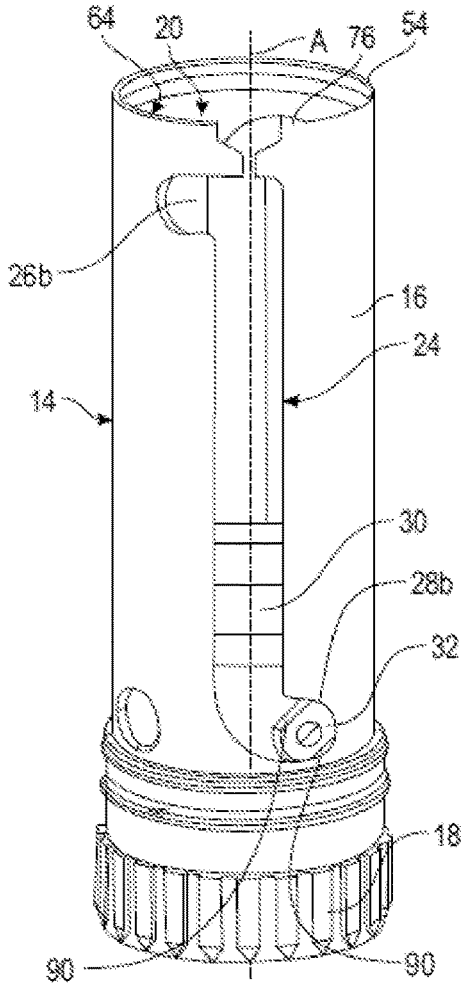

[Fig.15]
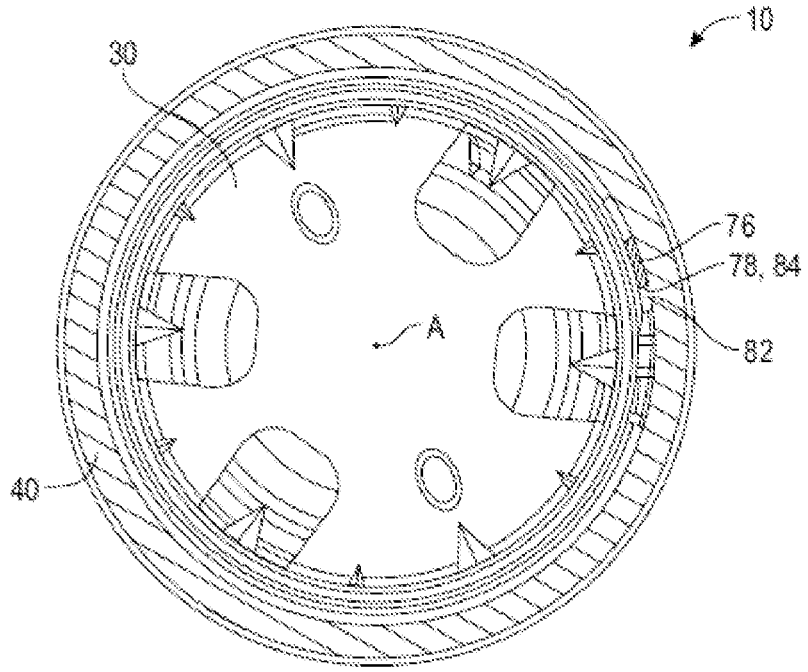
[Fig.16]
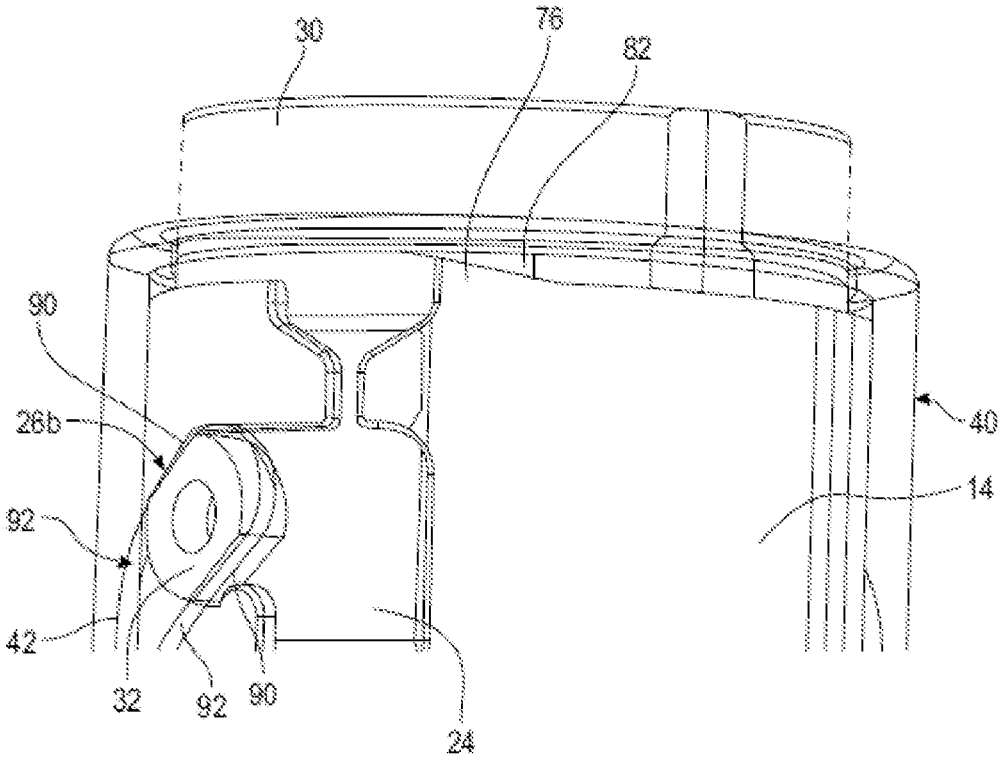

DEVICE FOR A COSMETIC PRODUCT, IN PARTICULAR A LIPSTICK

CROSS REFERENCE TO RELATED APPLICATIONS

This application claims priority under 35 U.S.C. § 119(a) to French patent application number 2106377, filed on Jun. 16, 2021, the entire teachings of which are incorporated herein by reference.

BACKGROUND OF THE INVENTION

Field of the Invention

The invention relates to a device for the packaging of a cosmetic product, such as a stick of cosmetic product, in particular a lipstick. The invention relates more particularly to a device intended to be mounted on a base for actuating a cosmetic product application receptacle

Description of the Related Art

Devices of this type are known from the prior art for packaging a cosmetic product, such as a stick of cosmetic product, in particular, but not exclusively for a lipstick.

The stick is held by its base in a cup which slides axially between at least one retracted position and one position for applying the cosmetic product in which at least one part of the cosmetic product stick extends axially out of the device.

In a known manner, such a kinematics is obtained thanks to a rotary mechanism including a guide and a sheath which, mounted concentrically, include for the one at least one slide and for the other at least one helical groove which are respectively crossed radially by at least one lug integral with the cup carrying the stick.

The cup generally includes a pair of lugs, the two lugs being arranged diametrically opposite each other, the guide being provided with two slides and the sheath with two helical grooves.

The actuation of the mechanism is generally controlled manually by applying a rotational movement to the base of the device, which rotational movement is transmitted to the mechanism to cause the axial displacement of the cup including the cosmetic product.

When the mechanism is actuated, it is possible for the lugs of the cup to come out of the slides and/or the helical grooves, in particular at the end of the stroke, in particular in the retracted position, if the actuation is forced.

Typically, the cup is made of polyoxymethylene (POM) or acrylonitrile butadiene styrene (ABS), while the other elements are made of a different material. Although there is a relative difference in hardness between the parts, it is regularly observed that the lugs of the cup emerge from the helical grooves of the sheath and/or the slides of the guide.

Moreover, this problem is also present in the use of a mono-material mechanism, i.e. a mechanism in which the cup, the sheath and the guide are made of the same material, in particular a plastic material.

The use of a same material to make the mechanism is particularly interesting for the recycling after use of the cosmetic product. Indeed, the presence of two different materials, presents disadvantages during the recycling where the two parts must be separated.

The purpose of the invention is in particular to propose a solution which allows to resolve at least some of the disadvantages of the prior art, in particular a solution which allows to avoid a deterioration of the device if a user forces on the actuation, in particular if the user forces the actuation in rotation.

BRIEF SUMMARY OF THE INVENTION

Thus, the invention concerns a device intended to be mounted on a base for actuating a cosmetic product application receptacle, in particular a cosmetic product stick, the device being designed to get the cosmetic product out by at least one rotational movement, the device including at least one guide, a cup intended to receive the cosmetic product and a sheath, the sheath including internally at least one helical groove and the guide being rotatably mounted in the sheath, the rotation of the guide relative to the sheath causing an axial movement of the cup between a fully extended position and a fully retracted position.

According to the invention, the device includes at least one means for rotationally locking the guide relative to the sheath when the cup is in the fully extended position and/or the fully retracted position and/or close to being in the fully extended position and/or the fully retracted position.

The fully retracted position corresponds to a position in which the cosmetic product is inside the device for its protection and its storage and the cup is in the bottom end-of-stroke position.

The fully extended position corresponds to a position in which the cosmetic product is extended axially upwards so that its free end extends out of the device through the opening and the cup is in the top end-of-stroke position.

"Close to" means on the verge of, within a short distance of, nearly in the fully extended position or fully retracted position.

Thus, when the cup is at the top or bottom end-of-stroke or close to be at the top or bottom end-of-stroke, the locking means stops the rotation of the guide in relation to the sheath. Thus, if the user forces the device to rotate, it is not the cup that serves as the end-of-stroke locking means but the rotational locking means between the guide and the sheath. This limits any risk of deterioration of the device, in particular of the cup, such as a deformation and/or a premature wear leading, for example, to an untimely removal of the cup from the device causing a malfunction of the device.

According to various embodiments of the invention, which may be taken together or separately:

- the guide, the cup and the sheath are made of plastic material,
- the guide, the cup and the sheath are made of identical plastic material,
- the plastic material is polypropylene,
- the device has an upper portion located towards an opening of the device through which the cosmetic product comes out and an opposite lower portion,
- the rotation locking means is located at the level of the upper portion of the device,
- the rotation locking means is located at the level of the lower portion of the device,
- the rotation locking means includes a plurality of stops configured to cooperate together,
- at least one of the stops is located on the guide and cooperates with at least one other of the stops located on the sheath,
- the at least one stop of the guide and the at least one stop of the sheath are complementary in shape so as to cooperate together, one of the plurality of the stops is a leg projecting axially from a base towards a free end and/or the other of the plurality of the stops is a radial excess thickness of material, the at least one stop of the guide is a leg projecting axially from a base to a free end, the at least one stop of the sheath is a radial excess thickness of material projecting towards the interior of the device, the at least one stop of the guide is a radial excess thickness of material projecting towards the outside of the device, the at least one stop of the sheath is a leg projecting axially from a base to a free end, the leg has a wide base and a narrow free end, the leg includes two sides extending between the base and the free end, at least one of the sides of the leg is vertical and cooperates with a vertical side of the radial excess thickness of material, the at least one of the sides of the vertical leg cooperates with the vertical side of the radial excess thickness of material when the cup is in the fully retracted position and/or close to being in the fully retracted position, the other of the sides of the leg is inclined and cooperates with an inclined side of the radial excess thickness of material, the at least one of the sides of the inclined leg cooperates with the inclined side of the radial excess thickness of material when the cup is in the fully extended position and/or close to being in the fully extended position, the cup includes at least one lug projecting radially outwardly and cooperating with at least one slide of the guide, the at least one slide and the at least one lug are configured to serve as a means for rotationally locking the cup relative to the guide when the cup is in the fully extended position and/or the fully retracted position and/or close to being in the fully extended position and/or the fully retracted position, the at least one lug has two parallel flat spots configured to cooperate with walls of the at least one helical groove of the sheath, the flat spots have an inclination similar to an inclination of a path of the helical grooves.

The invention also relates to a receptacle for applying a cosmetic product including a cover, an actuation base which includes a device as described above, the actuation base allowing to actuate the device so as to allow the entry and/or the exit of the cosmetic product.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is a perspective view of a guide, a sheath and a cup forming a device for a stick of cosmetic product according to a first embodiment in which the cup is in a fully extended position;

FIG. 2 is a perspective view of the assembled device of FIG. 1;

FIG. 3 is a detail view of the assembled device of FIG. 2;

FIG. 4 is a cross-sectional view A-A of the assembled device of FIG. 2;

FIG. 5 is a perspective view of the assembled device according to the first embodiment of FIG. 1 in which the cup is in the fully retracted position;

FIG. 6 is a detail view of the assembled device of FIG. 5;

FIG. 9 is a longitudinal cross-sectional view of the assembled device of FIG. 8 in which the cup (not present) is in the fully extended position;

FIG. 10 is a detail view of the assembled device of FIG. 9;

FIG. 11 is a C-C cross-sectional view of the assembled device of FIG. 9;

FIG. 12 is a perspective view of the assembled device according to the second embodiment of FIG. 8 in which the cup is in the fully retracted position;

FIG. 15 is a D-D cross-sectional view of the assembled device of FIG. 13;

FIG. 16 is a transparent perspective detail view showing a particular shape of a lug of the cup of the device of FIG. 8.

DETAILED DESCRIPTION OF THE INVENTION

Figure 7:
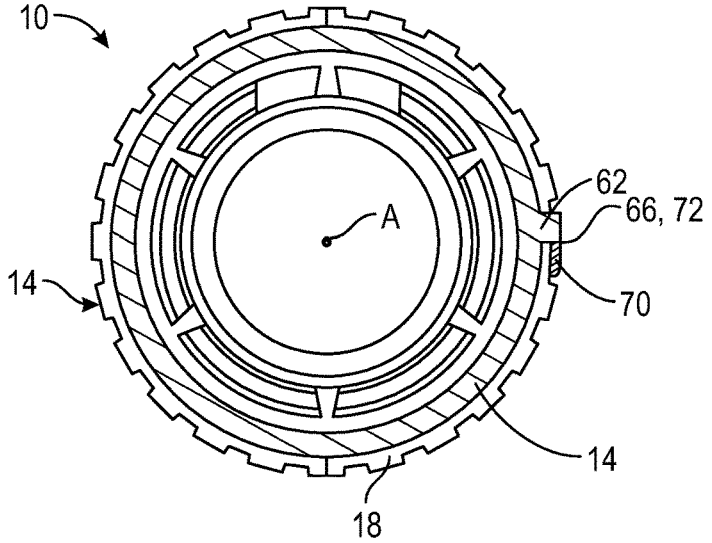
FIG. 7 is a B-B cross-sectional view of the assembled device of FIG. 5.
Figure 8:
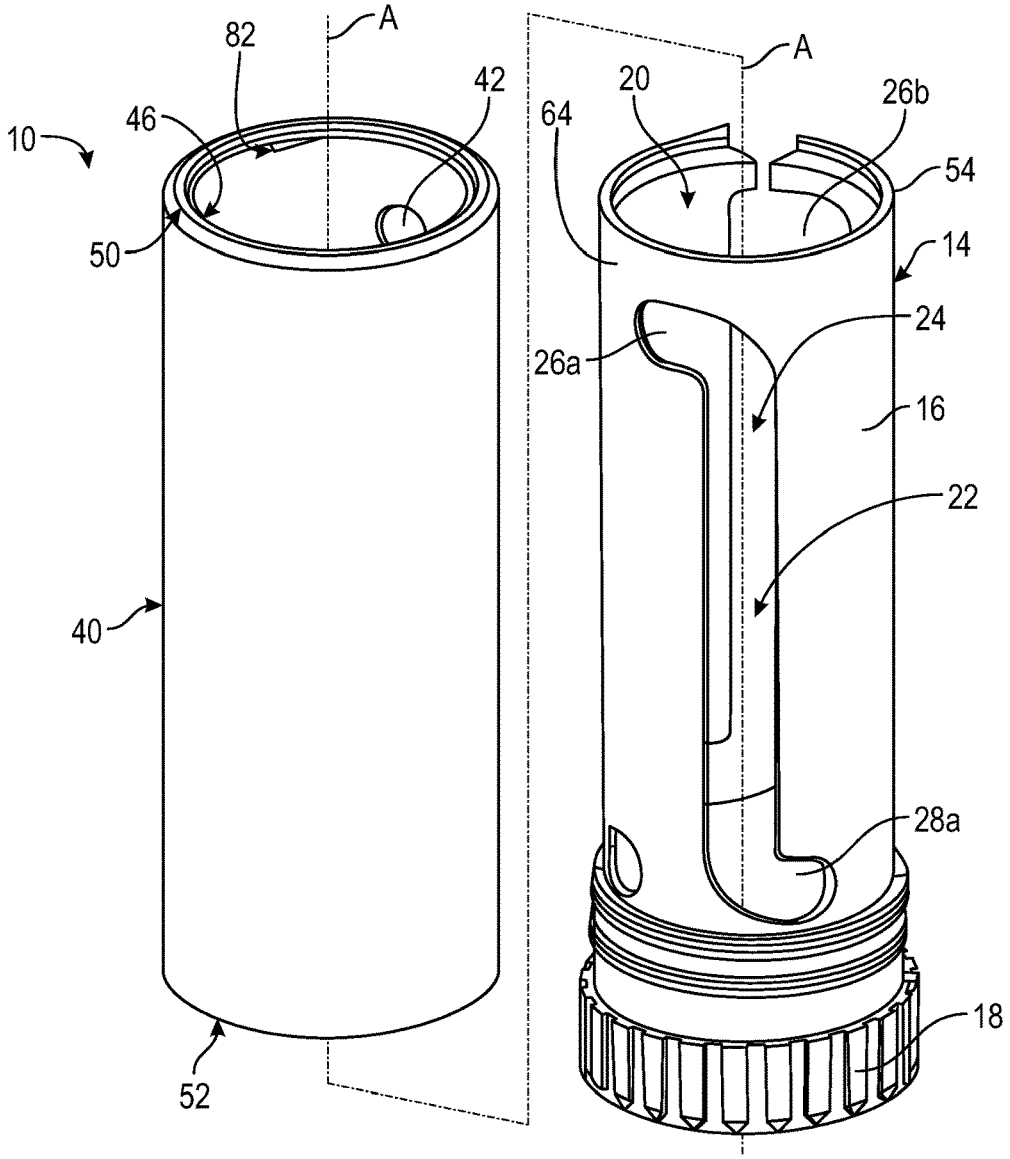
FIG. 8 is a perspective view of a guide and a sheath forming a device for a stick of cosmetic product according to a second embodiment.

By convention, the "axial" direction corresponds in the figures to that of the main axis A of the device (also referred to as mechanism) intended to be mounted on a base for actuating a cosmetic product application receptacle, such as a stick of cosmetic product, in particular a lipstick, and the "radial" direction is orthogonal to the axial direction.

In the following detailed description of the figures, the terms "upper" and "lower" or "top" and "bottom" will be used in a non-limiting manner with reference to the axial direction, the upper part of the device corresponding to that through which the stick of cosmetic product comes out from the device for its application.

Similarly, the terms "outer or external" and "inner or internal" are used with reference to the radial direction, an outer element being radially further from the axis A than an inner element.

FIGS. 1 to 7 illustrate a first embodiment of a device 10 intended to be mounted on a base for actuating a cosmetic product application receptacle according to the invention.

FIGS. 8 to 15 illustrate a second embodiment of a device 10 intended to be mounted on a base for actuating a cosmetic product application receptacle according to the invention.

Preferably, the cosmetic product (shown in dotted lines in FIG. 2) is a stick 12 of cosmetic product, and more particularly, the stick 12 of cosmetic product is a lipstick intended to be applied by rubbing on, alternatively a lip care balm.

The device 10 is designed to get the cosmetic product out by at least one rotational movement.

The device 10 has an axis A, referred to as main axis.

The device 10 includes at least one first element, conventionally and hereinafter referred to as guide 14.

The guide 14 primarily includes a tubular body 16 which extends axially from a hub 18 forming the lower end of the guide 14 to an upper exit opening 20 intended to be passed through by the stick 12 of cosmetic product.

For example, the external surface of the hub 18 is for example provided with striations to facilitate its handling when using the device 10.

Preferably, the guide 14 includes two slides, respectively a first slide 22 and a second slide 24, which are constituted by slots passing radially through the wall of the body 16 and are arranged diametrically opposite each other.

The slides 22, 24 extend axially in the body 16 of the guide 14, the first slide 22 is axially closed at its upper end while the second slide 24 is open. The slides 22, 24 are closed at their lower end located on the side of the hub 18.

The slides 22, 24 each includes straight and parallel edges. The first slide 22 includes an upper indentation 26*a* at one of its axial ends and a lower indentation 28*a* at the other of its axial ends, the indentations 26*a*, 28*b* extending circumferentially.

In both example embodiments, the second slide 24 also includes upper and lower indentations 26*b*, 28*b*.

In conventional systems, the indentations 26*a*, 26*b*, 28*a*, 28*b* are intended to form end-of-stroke locking means for a cup 30.

The device 10 includes the cup 30 which receives the stick 12 of cosmetic product as shown in FIG. 2.

The cup 30 is intended to be axially slidably mounted in the guide 14 between a fully retracted position and a fully extended position.

Figure 13:
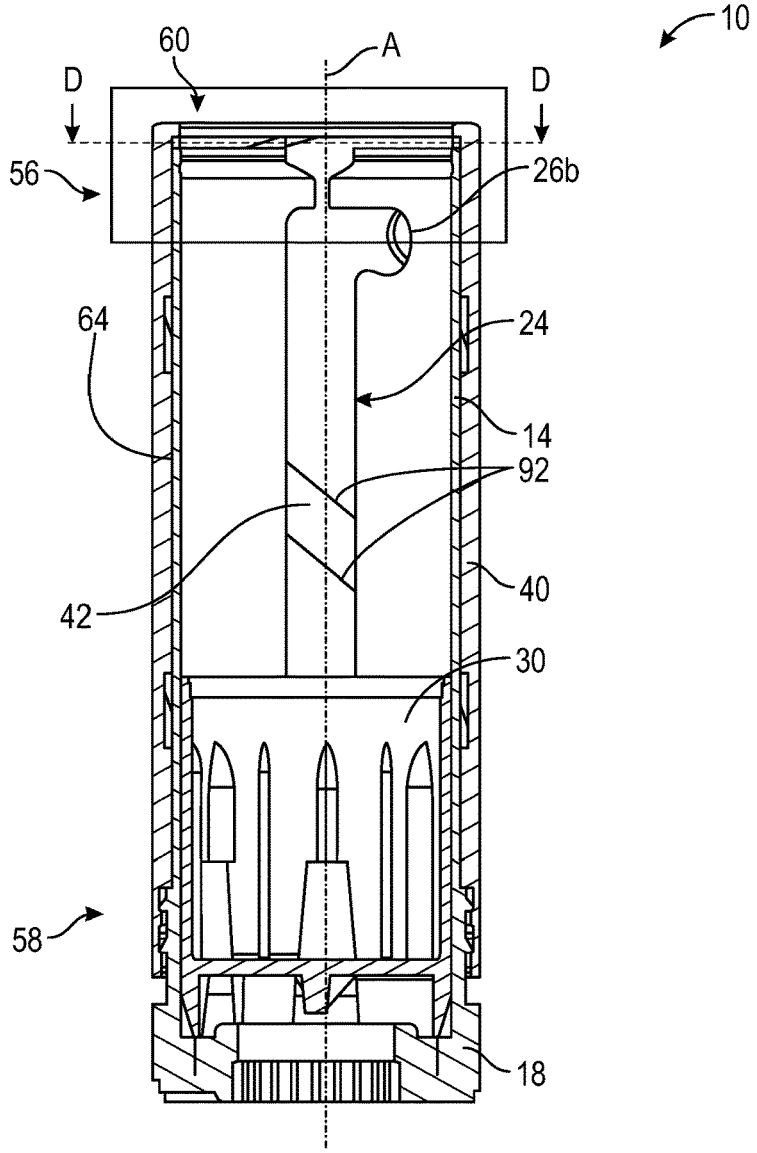
FIG. 13 is a longitudinal cross-sectional view of the assembled device of FIG. 12.

The fully retracted position corresponds to a position in which the stick 12 is inside the device 10 for its protection and its storage and the cup 30 is in the bottom end-of-stroke position as shown in FIGS. 12 and 13.

The fully extended position corresponds to a position in which the stick 12 is extended axially upwardly so that its free end extends out of the device 10 through the opening 20 and the cup 30 is in the top end-of-stroke position as illustrated in FIGS. 1 and 2.

The cup 30 may also be in intermediate retracted positions and intermediate extended positions, referred to as intermediate application positions.

The intermediate retracted positions correspond to positions in which the stick 12 is inside the device 10 for its protection and its storage but without the cup 30 being at the low end-of-stroke.

The intermediate application positions correspond to positions in which the stick 12 is extended axially upwardly so that its free end extends out of the device 10 through the opening 20 and it is possible to apply the cosmetic product.

Preferably, the cup 30 includes two lugs 32 projecting radially outwardly, the lugs 32 each engaging one of the slides 22, 24 of the guide 14 and passing therethrough to extend radially outwardly beyond the external surface of the body 16 of the guide 14.

The cup 30 includes a cylindrical wall which, extending axially over a given height, defines a housing which receives the lower part of the stick 12 and a bottom.

In a variant not shown, the cup is made in two parts, respectively an upper cup intended to receive the stick of cosmetic product and a lower cup which, also sometimes referred to as "cup motor", cooperates with the mechanism of the device to ensure the sliding between the retracted and application positions.

In such an alternative, the two parts of the cup are integrally connected to each other, for example by interlocking.

The device 10 includes a second element, hereinafter referred to as the sheath 40. As shown here, the sheath 40 has a cylindrical shape.

The sheath 40 may receive an outer sleeve (not shown) within which the sheath 40 is inserted and rotationally fixed due to the force fitting or alternatively, for example, the use of adhesive to attach the sheath 40 and the sleeve together.

In the remainder of the description, the term "sheath" should therefore be interpreted in a non-limiting manner as also referring to an assembly consisting of a sheath 40 and such a sleeve.

Preferably, the sheath 40 includes diametrically opposed helical grooves 42, 44 therein with which the free ends of the lugs 32 of the cup 30 cooperate in operation. The sheath 40 includes an internal wall 46 provided with the helical grooves 42, 44.

The sheath 40 includes an upper edge 50 located at its upper axial end and a lower edge 52 located at its lower axial end, respectively, the edges 50 and 52 being circumferentially continuous.

The sheath 40 is intended to be mounted by snap-fitting on the guide 14 to obtain, after assembly, the devices 10 shown in particular in FIGS. 2, 5 and 13.

The guide 14 is rotatably mounted in the sheath 40.

In such a device 10, rotating the guide 14 by means of its hub 18 relative to the sheath 40 causes an axial movement of the cup 30, more precisely an upward movement or a downward movement of the cup 30 depending on the direction of rotation.

The stick 12 of cosmetic product moves axially with the cup 30 between the fully extended position and the fully retracted position.

In the two embodiments shown, the guide 14, the cup 30 and the sheath 40 are advantageously made of plastic material.

Preferably, the guide 14, the cup 30 and the sheath 40 are made of identical plastic material.

The plastic material may be selected from polypropylene (PP), polyethylene terephthalate (PET), recycled polyethylene terephthalate (R-PET), thermoplastic elastomer (TPE), polyethylene (PE), such as the low density polyethylene (LDPE) and/or the high density polyethylene (HDPE), a composite material, a post-consumer recycled (PCR) material and/or the like.

These include in particular plastic material with a hardness of between 70 shore A and 90 shore D.

Preferably, it is polypropylene and/or polyethylene terephthalate, whether recycled or not.

Thus, advantageously, all the parts of the device 10 are made of plastic material preferably selected from the polypropylene and/or the polyethylene terephthalate.

The parts of plastic material can be easily obtained by injection and lead to a lightweight device 10.

Furthermore, the use of plastic materials, in particular similar plastic materials for the entire device 10 allows to facilitate the recycling. In particular, the polypropylene and the polyethylene terephthalate are two plastic materials whose recycling cycle is well known.

The guide 14 includes, axially at its upper end, a rim 54 which extends radially outwardly.

The rim 54 is circumferentially interrupted at the level of the upper open end of the slide 24 whereby the guide 14 may be radially deformed to facilitate the mounting of the sheath 40 before returning to its original shape.

According to the invention, in both illustrated embodiments, the device 10 includes a means for rotationally locking the guide 14 relative to the sheath 40 when the cup 30 is in the fully extended position and/or the fully retracted position and/or close to being in the fully extended position and/or the fully retracted position.

"Close to" means on the verge of, within a short distance of, nearly in the fully extended position or fully retracted position.

Advantageously, the rotation locking means is located at the level of an upper portion 56 of the device 10 and/or at the level of a lower portion 58 of the device 10.

The upper portion 56 of the device 10 is located toward an opening 60 of the device 10 intended to be passed through by the stick 12 of cosmetic product and through which the cosmetic product comes out.

The lower portion 58 is the portion opposite the upper portion 56 and at the level of which the hub 18 is located.

Advantageously, the rotation locking means includes a plurality of stops configured to cooperate together.

In particular, at least one of the stops is located on the guide 14 and cooperates with at least one other of the stops located on the sheath 40.

Thus, the at least one stop of the guide 14 and the at least one stop of the sheath 40 may be complementary in shape so as to cooperate together.

In the first embodiment, the rotation locking means is located at the level of the lower portion 58 of the device 10. These are two stops, one of which is located on the guide 14 and the other is located on the sheath 40.

The stop located on the guide 14 is a radial excess thickness 62 of material projecting from an external surface 64 of the guide 14. The excess thickness 62 is disposed in a lower portion 58 of the guide 14 located axially above the hub 18 of the guide 14.

The excess thickness 62 is elongated in shape and extends axially from the hub 18 towards the opening 60 of the device 10.

The excess thickness of material 62 includes a vertical side 66 and an inclined side 68. In other words, the excess thickness 62 has a generally trapezoidal shape.

The stop located on the sheath 40 is a leg 70 projecting axially from the lower edge 52 of the sheath 40. The leg 70 extends from a wide base at the level of the lower edge of the sheath 40 to a narrow free end.

The leg 70 includes a vertical side 72 and an inclined side 74. In other words, the leg 70 has a generally trapezoidal shape.

In this first embodiment, when the cup 30 is in the fully retracted position and/or close to being in the fully retracted position the vertical side 72 of the leg cooperates with the vertical side 66 of the radial excess thickness of material 62 as illustrated in FIGS. 5 and 6.

Thus, when the cup 30 is at the bottom end-of-stroke or is reaching the bottom end-of-stroke, the two stops 62, 70 come into contact. The rotation of the guide 14 relative to the sheath 40 is thus stopped in the downward direction of the cup 30, thereby locking the rotation of the cup 30 in the downward direction.

Thus, in contrast to a conventional device of the prior art, it is not the lugs 32 of the cup 30 that serve as an end-of-stroke lock but the stops 62, 70. This limits any risk of the malfunctioning of cup 30, in particular a removal of the lugs 32 from the slides 22, 24 of the guide 14 and/or from the helical grooves 42, 44 of the sheath 40.

The fully retracted position is the most stressed position of the cup 30 and the one where the risk of malfunctioning is the greatest since the cup 30 inside the device 10 is not visible. In this position, the vertical sides 66, 72 of the stops 62, 70 come into contact with each other, thus allowing a greater strength to be absorbed.

When the cup 30 is in the fully extended position and/or close to being in the fully extended position, it is the inclined sides 68, 74 of the leg 70 and of the radial excess thickness of material 62 that cooperate as illustrated in FIGS. 2 and 3. In other words, at the top end-of-stroke of the cup 30, the two inclined sides 68, 74 of the stops 62, 70 come into contact locking the upward rotation of the guide 14 with respect to the sheath 40, consequently locking the rise of the cup 30. Again, it is the stops 62, 70 that serve as the end-of-stroke lock and not the lugs 32 of the cup 30. This limits any risk of malfunctioning of the cup 30, in particular a removal of the lugs 32 from the slides 22, 24 of the guide 14 and/or from the helical grooves 42, 44 of the sheath 40.

In the second embodiment, the principle of rotation locking is similar. Again, it is not the lugs 32 of the cup 30 that serve as the end-of-stroke lock, but stops located on the sheath and the guide. This limits any risk of malfunctioning of the cup 30, in particular a removal of the lugs 32 from the slides 22, 24 of the guide 14 and/or from the helical grooves 42, 44 of the sheath 40.

This second embodiment differs from the first by the location of the stops and their shape.

In the second embodiment, the rotation locking means is located at the level of the upper portion 56 of the device 10. These are two stops, one of which is located on the guide 14 and the other is located on the sheath 40.

The stop located on the guide 14 is a leg 76 projecting axially from the upper rim 54 of the guide 14. The leg 76 extends from the upper rim 54 of the guide 14 at the level of the indentation **26*b* and of the interruption in the circumference of the rim 54**.

The leg 76 extends from a wide base at the level of the upper rim 54 of the guide 14 to a narrow free end.

The leg 76 includes a vertical side 78 and an inclined side 80. In other words, the leg 76 has a general triangle shape.

The stop located on the sheath 40 is a radial excess thickness of material 82 projecting from the internal surface of the sheath 40. The excess thickness 82 is disposed in an upper portion 56 of the sheath 40.

The excess thickness 82 is elongated in shape and extends circumferentially at the level of the upper edge 54 of the sheath 40. The excess thickness of material 82 has a vertical side 84 and an inclined side 86. In other words, the excess thickness 82 has a generally triangular shape.

Figure 14:
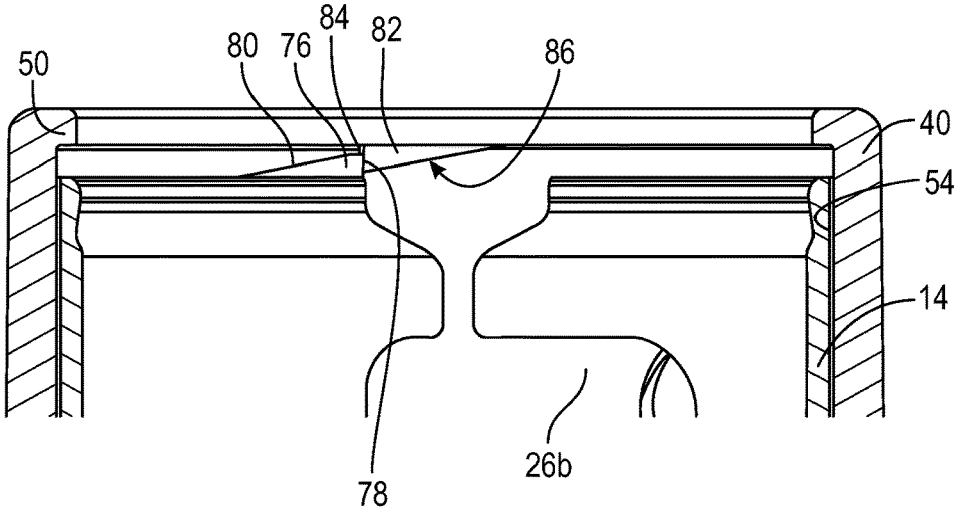
FIG. 14 is a detail view of the assembled device of FIG. 13.

As in the first embodiment, when the cup 30 is in the fully retracted position and/or close to being in the fully retracted position the vertical side 78 of the leg 76 cooperates with the vertical side 84 of the radial excess thickness of material 82 as illustrated in FIGS. 13 and 14.

When the cup 30 is in the fully extended position and/or close to being in the fully extended position, it is the inclined sides 80, 86 of the leg 76 and the radial excess thickness of material 82 that cooperate as shown in FIGS. 9 and 10.

Advantageously, in each of the embodiments, the stops 62, 70, 76, 82 have a vertical side 66, 72, 78, 84 and an inclined side 68, 74, 80, 86, implying a generally triangular or trapezoidal shape.

This particular shape with a wide base allows to reinforce the strength of the stops 62, 70, 76, 82 to prevent them from breaking, in particular when the user forces them in rotation.

In addition, the inclined sides 68, 74, 80, 86 allow to limit the reduction in rotational movement of the cup 30. Because of this particular shape, the stops 62, 70, 76, 82 do not interfere with the rising and lowering of the cup 30, which can be done with the same amplitude as for a conventional device.

The stops 62, 70, 76, 82 are configured so that in the fully retracted position of the cup 30, the position most requested by the user, the vertical sides 66, 72, 78, 84 cooperate allowing to absorb a greater strength.

Furthermore, in each of the two embodiments shown, the two lugs 32 of the cup 30 are generally rounded in shape and advantageously have two parallel flat spots 90 configured to cooperate with walls 92 of the helical grooves 42, 44 of the sheath 40.

Preferably, the flat spots 90 have an inclination similar to the inclination of the path of the helical grooves 42, 44, as seen in FIG. 16.

In other words, each lug 32 extends in a direction similar to the direction of the helical groove 42, 44 in which it is engaged.

This particular shape of the lugs 32 is adapted to the shape of the helical grooves 42, 44 so as to facilitate their sliding and so that they house therein without coming out even if a user forces the rotation. This reduces the risk of malfunctioning of the cup 30.

The device 10 is intended to be a component of a receptacle (not shown), also referred to as case, of a cosmetic product.

Generally, the receptacle includes a cover which is associated with a complementary shaped actuation base, the base and the cover together defining an external outline of the receptacle.

The receptacle further includes the device 10 for dispensing the stick of cosmetic product such as described above.

In a non-limiting manner, the cover, the base of the receptacle and the device 10 have a cylindrical shape with circular section.

Preferably, the cover is removable. The cover is likely to occupy at least one open position in which the cover is separated from the base, in particular with a view to allowing the cosmetic product to be applied, and a closed position in which the cover is integral with the base.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A device intended to be mounted on an actuation base of a cosmetic product application receptacle, in particular a cosmetic stick, said device being designed to get the cosmetic product out by at least one rotational movement, said device comprising:

at least one guide, a cup intended to receive the cosmetic product;

a sheath comprising internally at least one helical groove and the guide being rotatably mounted in the sheath, the rotation of the guide relative to the sheath causing an axial movement of the cup between a fully extended position and a fully retracted position, and at least one rotation locking means for rotationally locking the guide relative to the sheath when the cup is in the fully extended position or the fully retracted position or an intermediate position closer to the fully extended position than the fully retracted position or closer to the fully retracted position than the fully extended position;

wherein the at least one rotation locking means comprises a plurality of stops configured to cooperate together, at least one of the stops being located on the guide and cooperating with at least one other of the stops located on the sheath, one of the plurality of the stops being a leg projecting axially from a base towards a free end and/or the other of the plurality of the stops is a radial excess thickness of material, wherein the leg comprises two sides extending between the base and the free end, at least one of the sides of the leg being vertical and cooperating with a vertical side of the radial excess thickness of material, the other of the sides of the leg being inclined and cooperating with an inclined side of the radial excess thickness of material.

2. The device according to claim 1, wherein the device has an upper portion located towards an opening of the device through which the cosmetic product comes out and an opposite lower portion, the at least one rotation locking means is located at a level of the upper portion of the device or at a level of the lower portion of the device.

3. The device according to claim 1, wherein the at least one stop of the guide and the at least one stop of the sheath are complementary in shape so as to cooperate together.

4. The device according to claim 1, wherein the cup comprises at least one lug projecting radially outwardly and cooperating with at least one slide of the guide, the at least one slide and the at least one lug being configured to serve as a means for rotationally locking the cup relative to the guide when the cup is in the fully extended position or the fully retracted position or in proximity to the fully extended position or in proximity to the fully retracted position.

5. The device according to claim 4, wherein the at least one lug has two parallel flat spots configured to cooperate with walls of the at least one helical groove of the sheath.

6. The device according to claim 5, wherein the flat spots have an inclination path of the helical grooves of the sheath.

7. A receptacle for applying a cosmetic product comprising:

a cover, an actuation base which comprises a device comprising:

at least one guide, a cup intended to receive the cosmetic product a sheath comprising internally at least one helical groove and the guide being rotatably mounted in the sheath, the rotation of the guide relative to the sheath causing an axial movement of the cup between a fully extended position and a fully retracted position, and at least one means for rotationally locking the guide relative to the sheath when the cup is in the fully extended position or the fully retracted position or an intermediate position closer to the fully extended position than the fully retracted position or closer to the fully retracted position than the fully extended position;

wherein the actuation base allows actuation of the device so as to allow an entry or an exit of the cosmetic product; and, wherein the guide, the cup and the sheath are made of polypropylene.

* * * * *